US005218914A

United States Patent [19]

Dickinson

[11] Patent Number: 5,218,914

[45] Date of Patent: Jun. 15, 1993

[54] STORAGE SHELF ASSEMBLY

[75] Inventor: Thomas Dickinson, St. Louis, Mo.

[73] Assignee: Contico International, Inc., St. Louis, Mo.

[21] Appl. No.: 620,141

[22] Filed: Nov. 30, 1990

[51] Int. Cl.[5] ..... A47B 3/00

[52] U.S. Cl. ..... 108/64; 297/248; 108/65; 108/111; 108/114

[58] Field of Search ..... 108/64, 89, 114, 111; 312/111; 211/182; 297/248

[56] References Cited

U.S. PATENT DOCUMENTS

| | | | |
|---|---|---|---|
| 2,738,883 | 3/1956 | Wineman, Jr. | 108/64 |
| 3,039,619 | 6/1962 | Lyon | 108/114 X |
| 3,261,307 | 7/1966 | Salroff | 108/64 |
| 3,521,579 | 7/1970 | Stafford | 108/64 |
| 3,977,528 | 8/1976 | Berger | 108/64 X |
| 4,013,022 | 3/1977 | Walter et al. | 108/114 |
| 4,706,576 | 11/1987 | James | 108/111 |
| 4,915,034 | 4/1990 | Grabe et al. | 108/65 |
| 4,989,519 | 2/1991 | Welsch et al. | 108/111 |

FOREIGN PATENT DOCUMENTS

| | | | |
|---|---|---|---|
| 289261 | 3/1965 | Netherlands | 297/248 |

*Primary Examiner*—Peter A. Aschenbrenner
*Attorney, Agent, or Firm*—Rogers, Howell & Haferkamp

[57] ABSTRACT

A storage shelf assembly has a plurality of shelves, each shelf being of one-piece, integrally molded, plastic construction, and having a socket at an end thereof for positioning adjacent a socket of a shelf of a like storage assembly with said assemblies positioned in end-to-end relationship. The shelves are supported in horizontal, parallel, vertically spaced relation. A coupler is provided for coupling the like assemblies together in said end-to-end relationship. The coupler is of one-piece, integrally molded, plastic construction, and has spaced members adapted for insertion in the sockets, the spaced members of the coupler being maintained in fixed spaced relationship.

13 Claims, 2 Drawing Sheets

FIG. 1.
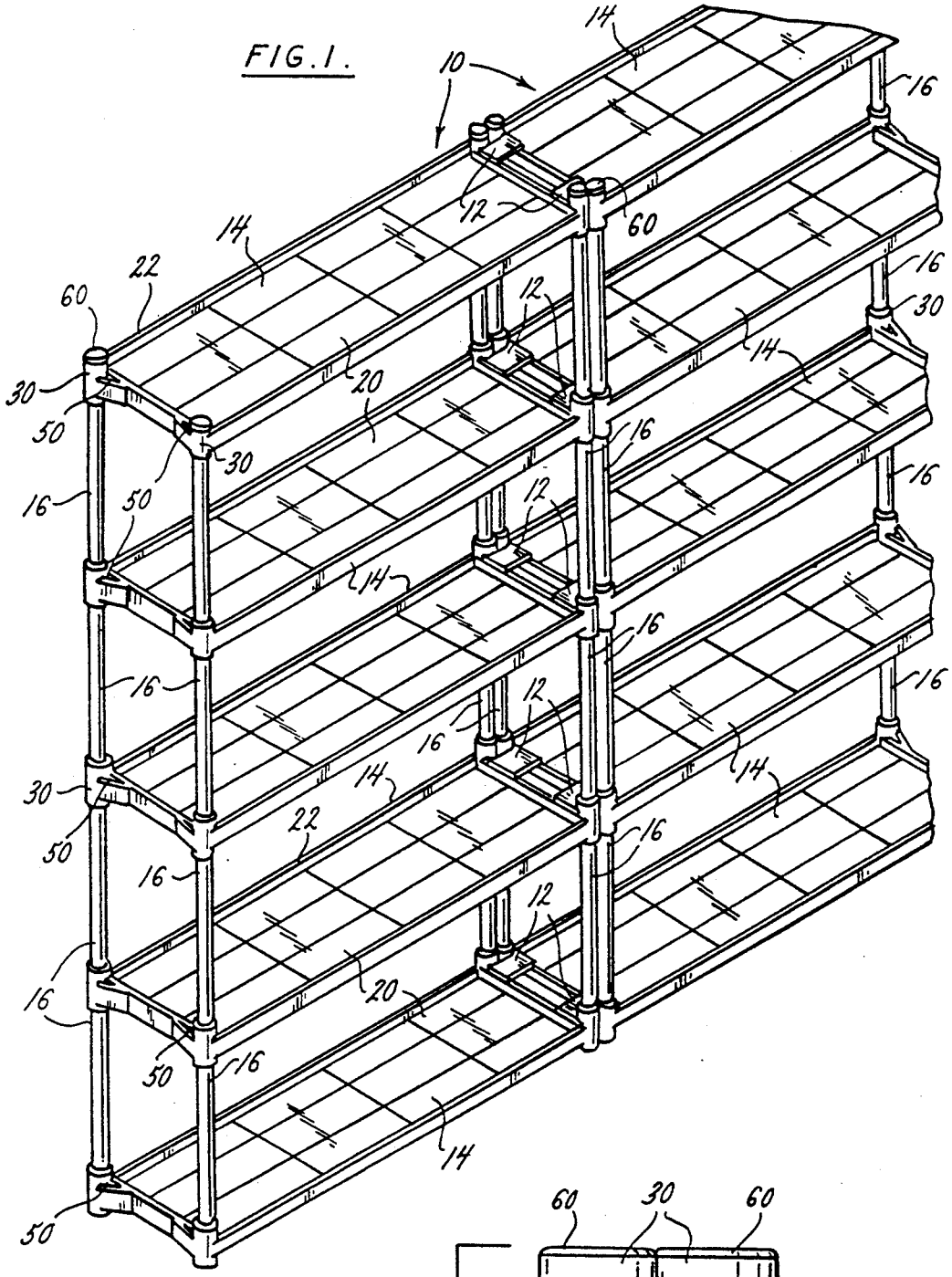
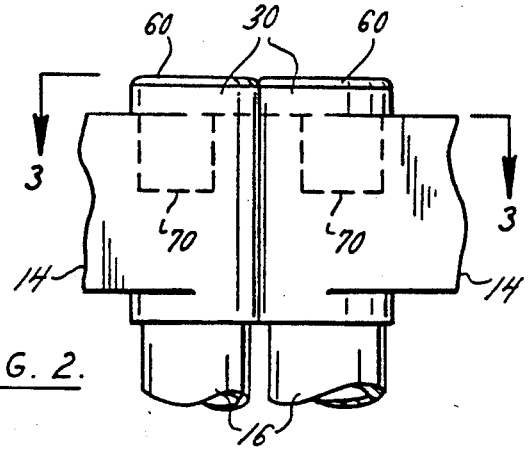
FIG. 2.

FIG. 3.
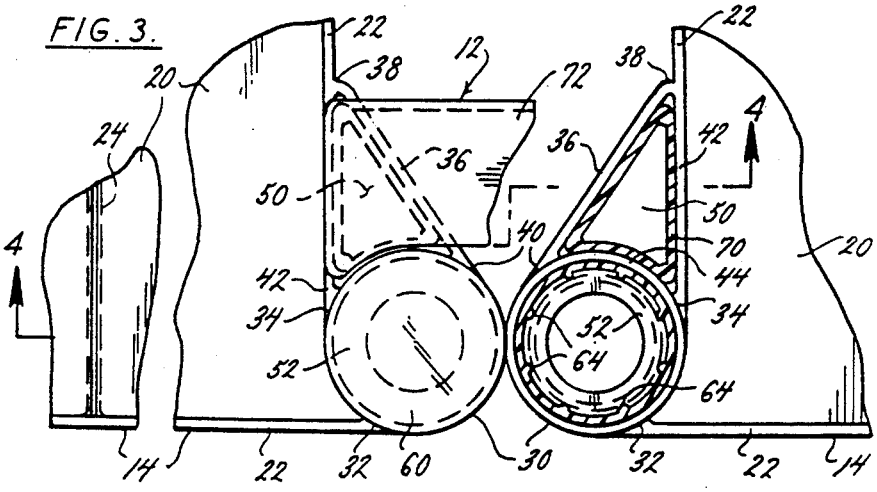
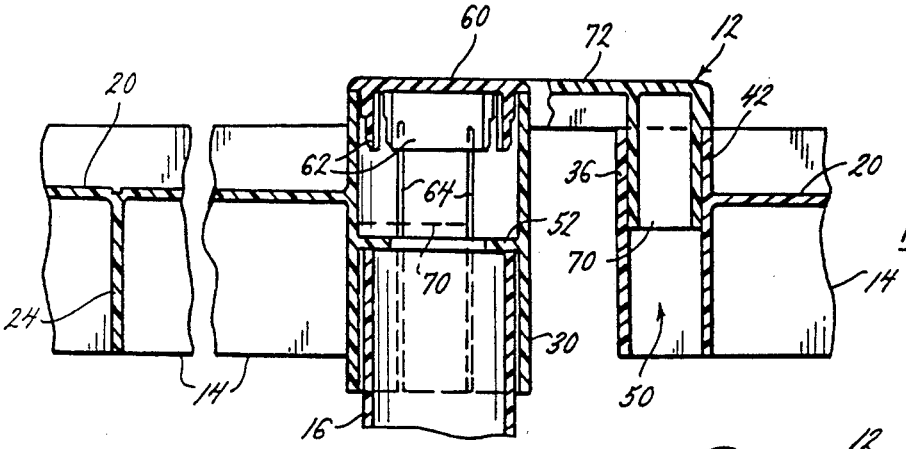
FIG. 4.
FIG. 5.
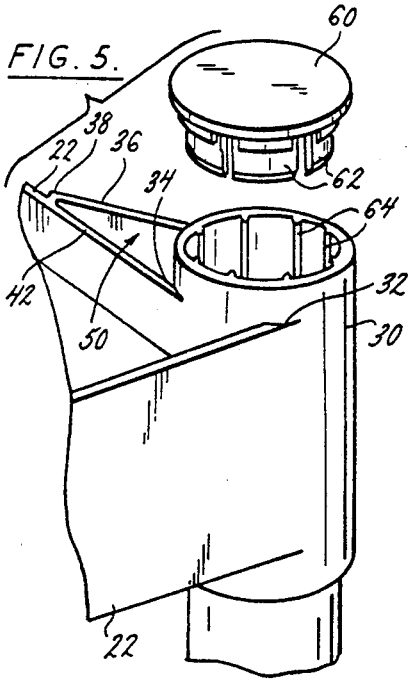
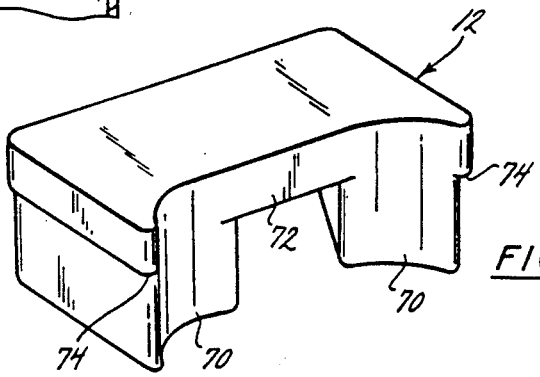
FIG. 6.
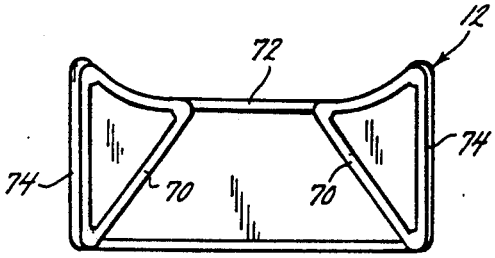
FIG. 7.

STORAGE SHELF ASSEMBLY

BACKGROUND AND SUMMARY OF THE INVENTION

This invention relates to a storage shelf assembly which is available for purchase in disassembled form and which is adapted for easy assembly by the customer. More particularly, the present invention relates to such an assembly which is adapted for use with one or more other like assemblies in end-to-end relationship, and which includes a coupler for securely coupling or connecting the like assemblies together.

Storage shelf assemblies of the general type to which the present invention relates are well known. Where such assemblies are made of metal, typically the component parts of each assembly are bolted together. Moreover, like assemblies are connected together in end-to-end relationship using bolts. While metal shelf assemblies are strong and offer good support, they are relatively expensive and time consuming to assemble and disassemble because of the many fasteners required.

Storage shelf assemblies are also known where the assemblies are of plastic construction. Typically, such assemblies are comprised of one-piece, integrally molded, shelves that are supported in parallel, vertically spaced relationship such as with plastic poles or the like. Each shelf may have a sleeve at the corner for receiving a support pole. Some plastic shelf assemblies may be assembled without the use of fasteners or the like. Such plastic shelf assemblies are strong and offer excellent support, and have the added advantage of being relatively inexpensive and easy to assemble and disassemble.

Generally, a primary object of the present invention is to provide a means for connecting like shelf assemblies together in end-to-end relationship, such that the assemblies may be connected together with ease, and such that the resultant structure is strong and exceptionally stable.

In accordance with the invention there is provided a storage shelf assembly having a plurality of shelves with means for supporting the shelves in horizontal, parallel, vertically spaced relation. At least one such shelf has a socket at an end thereof for positioning adjacent a socket of a shelf of a like storage assembly with said assemblies positioned in end-to-end relationship. The assembly of the present invention further comprises a coupler for coupling said like assemblies together in said end-to-end relationship. The coupler includes spaced members adapted for insertion in said sockets, and means for maintaining said members in fixed space relation.

In a preferred form of the invention, each shelf is of one-piece, integrally molded, plastic construction, and the shelves are structurally identical. Also in accordance with a preferred embodiment of the invention, the coupler is of one-piece, integrally molded, plastic construction. Preferably, each shelf has a vertical socket at each corner thereof adapted to receive a coupler member.

Also preferably, each shelf has a generally planer surface surrounded by a rim that is wider than the planer surface. A sleeve is located at each corner of the shelf for receiving a pole, the poles supporting the shelves in horizontal, parallel, vertically spaced relation. Each sleeve extends outwardly beyond the end rim of the shelf. A wall member at each corner of the shelf extends from an end rim of the shelf generally outwardly toward the sleeve, whereby a portion of a sleeve, a portion of the end rim, and a wall member combine to define a socket for receiving a coupler member. Each sleeve may be circular in cross-section.

The result is a storage shelf assembly having means for connecting the assembly to like assemblies in end-to-end relation, and where the assembly is strong yet relatively inexpensive, is easy to assemble without the use of time-consuming fasteners, and is exceptionally stable.

These and other objects and advantages of the invention are apparent from the drawings and detailed description to follow.

BRIEF DESCRIPTION OF THE DRAWINGS

FIG. 1 is a perspective view of storage shelf assemblies of the present invention coupled in end-to-end relationship in accordance with the invention;

FIG. 2 is a partial front elevation view taken at a junction between adjacent coupled assemblies;

FIG. 3 is a view taken generally along the line 3—3 of FIG. 2;

FIG. 4 is a view taken generally along the line 4—4 of FIG. 3;

FIG. 5 is a perspective, exploded, view of a top outside corner of an assembly;

FIG. 6 is a perspective view of a coupler of the present invention for coupling adjacent storage shelf assemblies; and FIG. 7 is a bottom view of the coupler of FIG. 6.

DETAILED DESCRIPTION OF THE PREFERRED EMBODIMENT

With reference to the drawing there are shown storage shelf assemblies 10 of the present invention coupled together in end-to-end relationship by couplers 12. Each shelf assembly 10 has a plurality of shelves 14 supported in horizontal, parallel, vertically spaced relation by vertical poles 16. Preferably the poles 16 are of plastic.

Each shelf 14 is of one-piece, integrally molded, plastic construction and has a generally planer surface 20 with an rim 22 extending around the perimeter of the planer surface. The rim 22 is substantially wider than the planer surface 20. The shelves also have vertical reinforcing ribs 24 that extend longitudinally and transversely beneath the planer surface to strengthen the shelf and reduce the amount by which the shelf will bow or sag under load.

Each shelf has a sleeve 30 formed at each corner. As shown in FIGS. 3 and 5, the sleeve 30 extends outwardly past the end rim of the shelf such that the front and back rims tangentially intersect the sleeve with the sleeve inwardly of the front and back rims, and the end rims tangentially intersect the sleeve with the sleeve outwardly of the end rims, as shown at 32 and 34 respectively.

Each corner of the shelf has a wall member 36 extending from the end rim at a location 38 outwardly toward the sleeve to tangentially intersect the sleeve at 40. Hence, the wall 36, the portion 42 of the end rim between locations 34 and 38, and the portion 44 of the sleeve 30 between locations 34 and 40 define a generally triangular vertical socket 50.

About midway within each sleeve 30 is a ring 52 which functions as an end stop for the poles 16. The ends of the poles 16 are inserted into the sleeves 30 until the ends of the poles abut against the stops 52.

Caps 60 are provided for the tops of the uppermost sleeves. The caps also preferably are of one-piece, integrally molded, construction and have flexible skirt members 62 that extend within the upper ends of the uppermost sleeves to provide a snug fit with the sleeve to secure the caps in place. The internal surfaces of the sleeves may have ribbing 64 to further facilitate a snug and secure fit between the sleeves and poles and also between the sleeves and caps.

The shelf assemblies are coupled in end-to-end relation as shown in FIG. 1 by the couplers 12. Each coupler 12 preferably is of one-piece, integrally molded, plastic construction, and includes spaced members 70 adapted for insertion in the vertical sockets 50, and having generally the same cross-sectional shape as the sockets 50. The members 70 are maintained in fixed spaced relation by an interconnecting support member 72. The members 70 are inset at the ends as shown at 74 so that with the coupler in place to couple adjacent shelf assemblies together, the ends of the coupler at 74 overlie the top edges of the portions 42 of the end rim 22 as shown in FIGS. 3 and 4. As shown in FIG. 7, the members 70 are mirror images of each other.

The manner of assembling the storage shelf assemblies is apparent from the foregoing description. To assemble each assembly, the ends of the poles 16 are inserted into the sleeves 30 of the shelves, and the caps 60 are pressed into the top ends of the uppermost sleeves. Adjacent assemblies are coupled in end-to-end relation by positioning the assemblies as shown in FIGS. 1–4 with the shelf assemblies in alignment and the sleeves generally next to each other. Couplers 12 are used to couple adjacent assemblies together by inserting the members 70 of the couplers into adjacent sockets 50.

While in FIG. 1 there is shown a coupler 12 at each corner of adjacent shelves, it is to be understood that a fewer number of couplers may be used to couple adjacent assemblies together and still provide stability. While the sleeves 30 and poles 16 are shown to be preferably of circular cross-section it is to be understood that other suitable cross-sections could be used. In addition, while the sockets 50 and coupler members 70 are shown to be preferably of generally triangular cross-section, other suitable cross-sections could be used.

What is claimed is:

1. A storage shelf assembly comprising:

a plurality of shelves;

means for supporting said shelves in horizontal, parallel, vertically spaced relation, at least one such shelf having a vertical socket at an end thereof for positioning adjacent a vertical socket of a shelf of a like storage shelf assembly with said assemblies positioned in end-to-end relationship;

a coupler for coupling said like assemblies together in said end-to-end relationship, said coupler having spaced members adapted for insertion in said vertical sockets, and means for maintaining said members in fixed spaced relationship.

2. The storage shelf assembly of claim 1 wherein said coupler is of one-piece, integrally molded, plastic construction.

3. The storage shelf assembly of claim 2 wherein each shelf of said storage shelf assembly is of one-piece, integrally molded, plastic construction.

4. The storage shelf assembly of claim 3 wherein said sockets and coupler members are of generally triangular shape.

5. The storage shelf assembly of claim 4 wherein the coupler members are mirror images of each other.

6. The storage shelf assembly of claim 3 wherein each shelf has a vertical socket at each corner thereof, all of the shelves of the assembly being structurally identical.

7. The storage shelf assembly of claim 6 wherein each shelf has a generally planer surface surrounded by a rim that is wider than said planer surface, a sleeve at each corner of the shelf for receiving a pole, the poles supporting the shelves in horizontal, parallel, vertically spaced relation, said sleeve extending outwardly beyond the end rim of the shelf, a wall member at each corner of the shelf extending from an end rim of the shelf generally outwardly toward said sleeve, whereby a portion of a sleeve, a portion of the end rim, and a wall member combine to define a socket.

8. The storage shelf assembly of claim 7 wherein each sleeve is circular in cross-section.

9. A storage shelf assembly comprising:

a plurality of shelves, each shelf being of one-piece, integrally molded, plastic construction, and having a socket at an end thereof for positioning adjacent a socket of a shelf of a like storage shelf assembly with said assemblies positioned in end-to-end relationship;

means for supporting said shelves in horizontal, parallel, vertically spaced relation; and a coupler for coupling said like assemblies together in said end-to-end relationship, said coupler being of one-piece, integrally molded, plastic construction, and having spaced members adapted for insertion in said sockets, and means for maintaining said members in fixed spaced relationship.

10. The storage shelf assembly of claim 9 wherein each shelf has a socket at each corner thereof, all of the shelves of the assembly being structurally identical.

11. The storage shelf assembly of claim 10 wherein each shelf has a sleeve at each corner of the shelf for receiving a pole, the poles supporting the shelves in horizontal, parallel, vertically spaced relation, a portion of each socket being formed by a portion of said sleeve.

12. The storage shelf assembly of claim 11 wherein each shelf has a generally planer surface surrounded by a rim that is wider than said planer surface, a portion of each socket being formed by a portion of said rim.

13. The storage shelf assembly of claim 11 wherein said sockets are vertical.

* * * * *